United States Patent [19]

Wheeler

[11] Patent Number: 4,518,957

[45] Date of Patent: May 21, 1985

[54] CIRCUIT BREAKER WARNING DEVICE

[76] Inventor: Rex W. Wheeler, 1202 S. Judson, Fort Scott, Kans. 66701

[21] Appl. No.: 480,938

[22] Filed: Mar. 31, 1983

[51] Int. Cl.[3] ..... G08B 21/00

[52] U.S. Cl. ..... 340/639; 340/638; 340/644; 200/5 R

[58] Field of Search ..... 340/638, 644, 639; 335/17; 200/5 R; 361/115

[56] References Cited

U.S. PATENT DOCUMENTS

| | | | |
|---|---|---|---|
| 520,378 | 5/1894 | Parson | 340/639 X |
| 2,405,929 | 8/1946 | Wald | 340/639 |
| 2,460,758 | 2/1949 | Lawson | 340/638 X |
| 2,476,236 | 7/1949 | Buckley | 340/638 X |
| 3,562,733 | 12/1967 | Murphy et al. | 340/638 |
| 3,683,350 | 8/1972 | Shedenheim | 340/638 |
| 4,056,816 | 11/1977 | Guim | 335/17 X |
| 4,128,750 | 12/1978 | Castonguay et al. | 200/308 |
| 4,166,989 | 9/1979 | Castonguay et al. | 340/638 X |
| 4,358,810 | 11/1982 | Wafer et al. | 340/638 X |

*Primary Examiner*—James L. Rowland
*Assistant Examiner*—Brian R. Tumm
*Attorney, Agent, or Firm*—Schmidt, Johnson, Hovey & Williams

[57] ABSTRACT

An alarm device for a circuit breaker box is provided that is especially designed for mounting on the face panel of conventional breaker boxes. The alarm device includes an audible signaling device and a switch box having a plurality of switches arranged in parallel electrical relationship for selectively coupling the audible signaling device to a source of operating power. The switch box includes a pair of spaced apart, apertured sidewalls for mounting the switches in side-by-side pairs of opposed switch members. A spring is interposed between each pair of switch members for urging the switch member pairs away from each other and into abutting relationship with electrical contacts carried by the sidewalls. In operation, the switch box is mounted between the vertical rows of breaker arm toggle switches of a conventional circuit breaker box. Individual alarm switch members are aligned in abutting contact with circuit breaker toggle switch members for shifting of the alarm switch members between open and closed positions in response to the shifting of the circuit breakers between normal and overload positions.

9 Claims, 9 Drawing Figures

CIRCUIT BREAKER WARNING DEVICE

BACKGROUND OF THE INVENTION

1. Field of the Invention

This invention relates to alarm devices for indicating the operating status of electrical circuits. In particular, the invention is concerned with a device that can be mounted on a conventional circuit breaker box that will give an audible signal when any of the circuits serviced by the breaker box are tripped.

2. Description of the Prior Art

Electrical circuits are invariably provided with either fuses or circuit breakers for disconnecting electrical power from the circuit when the circuit is drawing more power than its rated capacity. The circuit will remain disconnected until the circuit breaker is manually reset or the fuse is replaced. While such a feature is essential to safe operation, it is possible that a circuit can remain in a "tripped" condition for extended periods of time before the loss of electrical power to the circuit is detected. This is particularly disadvantageous where freezer equipment, or other electrical equipment requiring a continuous source of power are serviced by the electrical circuit.

A number of alarm devices have been provided in the past for indicating the status of the circuit breakers within a circuit breaker box. Illustrative of prior devices are U.S. Pat Nos. 520,378; 2,476,236; 2,460,758; 3,562,733; 3,683,350; and 4,166,989. None of the devices provided in the past, however, are suitable for easy retrofit on conventional circuit breaker boxes. An inexpensive alarm device that could be easily retrofitted onto conventional circuit breaker boxes would therefore be a decided advantage.

SUMMARY OF THE INVENTION

The problem outlined above is in large measure solved by the circuit breaker warning device in accordance with the present invention. That is to say, the circuit breaker warning device hereof is reliable, inexpensive, and can be easily mounted on the face plate of a conventional circuit breaker box without the need for special tools or professional skills.

The circuit breaker warning device hereof broadly includes an electrically actuated audible signaling device, and a switch box adapted for selective coupling of the signal device to a source of operating power. The switch box includes a pair of side-by-side, opposed sidewalls, a plurality of shiftable switch members carried by the sidewalls in side-by-side pairs of opposed switch members, and a spring interposed between each pair of opposed switch members for urging the members apart and into a closed position electrically connecting the alarm signal to a source of operating power.

In operation, the switch box is mounted on the face plate of a conventional circuit breaker box in between adjacent rows of circuit breaker arms. The circuit breaker arms abut the switch box switch members, maintaining the switch members in an open electrical position so long as the associated breaker arm is in the circuit closed position. The individual alarm switch members are shifted from their open to the closed position whenever the associated circuit breaker shifts from its circuit normal to circuit overloaded position, thereby connecting a source of operating power to the alarm for energization of the alarm.

DETAILED DESCRIPTION OF THE DRAWINGS

Figure 2:
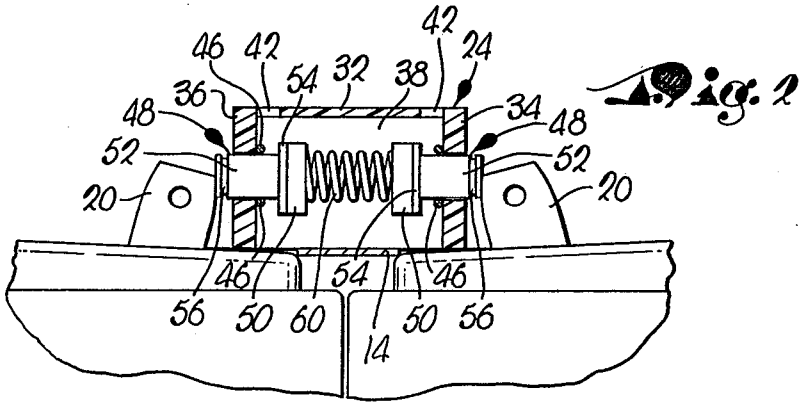
FIG. 2 is an enlarged, fragmentary, sectional view of the switch box of the circuit breaker warning device in accordance with the present invention mounted on the face plate of a circuit breaker box between adjacent rows of breaker arms.

Referring to the drawings, circuit breaker warning device 10 in accordance with the present invention is depicted mounted on the front panel of a conventional circuit breaker box 12. The circuit box 12 includes a face plate 14 having two, laterally spaced apart, juxtaposed vertical rows of circuit breaker arm-receiving openings 16, 18. A plurality of individual circuit breakers (not shown) are located behind the vertical rows of openings 16, 18, and corresponding shiftable breaker arms 20 extend through the openings. The circuit box 12 also includes a hingedly mounted front cover plate 21.

Figure 9:
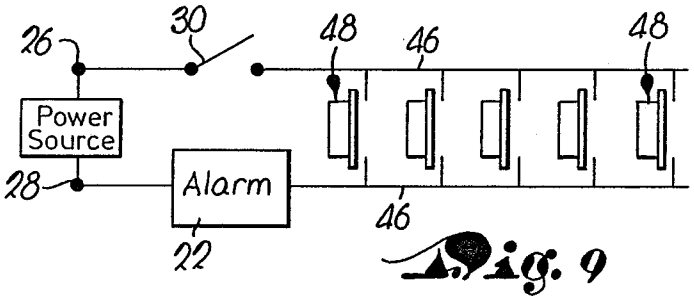
FIG. 9 is a wiring diagram of the circuit breaker warning device in accordance with the present invention.

The alarm device 10 broadly includes an audible signaling device 22 comprising an electrically actuated horn, and a switch box 24 adapted for connection of the horn 22 to a source of operating power at terminals 26, 28 (see FIG. 9). The device 10 is provided with an on/off switch 30, located on the lower panel of circuit breaker box 12.

The switch box 24 includes a top wall 32, a pair of spaced apart, opposed, apertured sidewalls 34, 36, and end walls 38. An apertured tab 40 extends from each end wall 38. Top wall 32 includes a row of rectangular slots 42 along each side margin thereof. Sidewalls 34, 36 each include a plurality of circular apertures 44, each aperture 44 being aligned with a respective slot 42. A pair of electrically conducting, spaced apart parallel wires 46 are carried on the internal face of each sidewall 34, 36, the apertures 44 being located in between respective pairs of wires 46.

Figure 6:
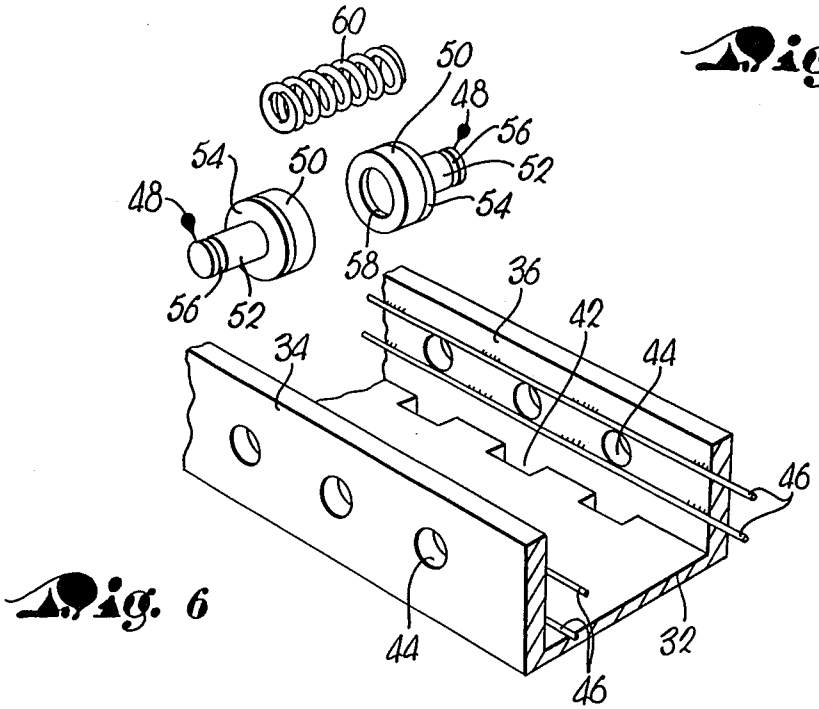
FIG. 6 is an enlarged, fragmentary, sectional, exploded view of the alarm device switch box.

A plurality of shiftable switch members 48 are carried within the switch box 24. The switch members 48 are arranged in side-by-side pairs of opposed switch members. Referring to FIG. 6, each switch member 48 includes an annular base portion 50, and a cylindrical portion 52 extending from the base portion 50. The base and cylindrical portions may be integrally molded from a synthetic resin material. Washer 54 comprising an electrically conducting element is carried by each switch member 48, and the cylindrical portion 52 of each switch member 48 includes an annular groove 56. The rear portion of each switch member 48 includes a circular cavity 58. A coil spring 60 is interposed between each pair of opposed switch members 48 received within cavities 58.

Figure 4:
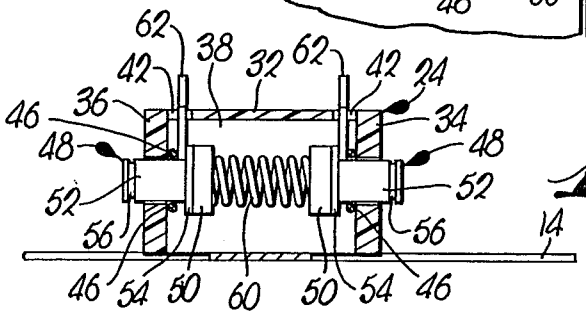
FIG. 4 is an enlarged, sectional view of the switch box with a pair of tabs inserted for holding the switches in their open position.
Figure 8:
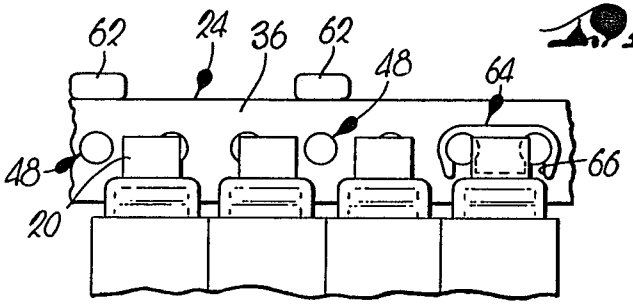
FIG. 8 is a fragmentary, side view of a circuit breaker box having an alarm device switch box mounted thereon.
Figure 5:
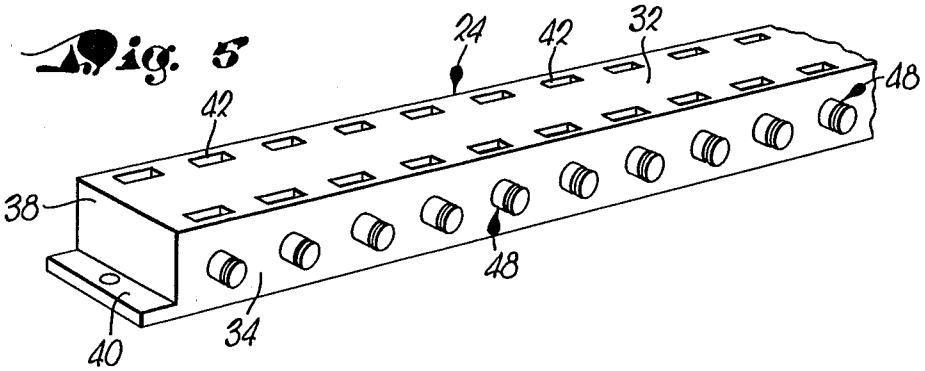
FIG. 5 is a fragmentary, perspective view of the alarm device switch box.

Referring to FIG. 4, it will be seen that a removable insert 62 may be received within slot 42 for abutting contact with the switch member 48. Referring to FIG. 8, it will be seen that a connecting hook 64 having a pair of spaced apart connection slots 66 may be received by the grooves 56 of a pair of side-by-side switch members 48.

In operation, the switch box 24 is mounted by bolts received through tabs 40 to the face plate 14 of a conventional circuit breaker box 12. The switch box 24 is mounted between adjacent rows of breaker arm receiving openings 16, 18 in the breaker box face plate. The audible signaling device 22 may be attached to the breaker box 12, or located at a convenient, spaced apart position. The alarm device 10 is placed in an operating condition by closing on/off switch 30.

Figure 3:
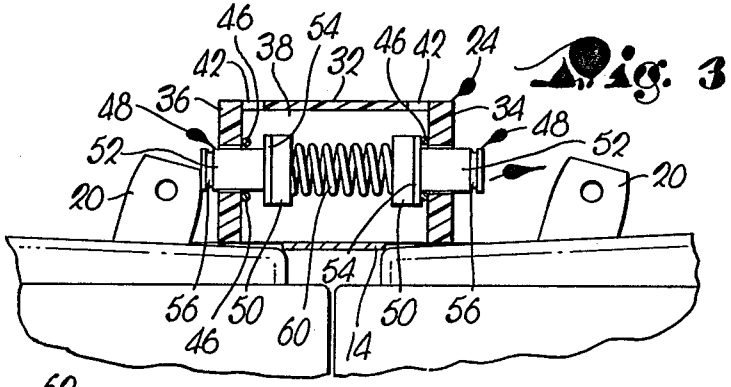
FIG. 3 is similar to FIG. 2 but with one of the breaker arms in a circuit overloaded position.

The circuit breaker arms 20 are shiftable between the circuit closed or normal position to a circuit open or overloaded position. Referring to FIGS. 2 and 3, the breaker arms 20 are in their circuit closed position when slanted toward the switch box 24, and are in the circuit open position when slanted away from the switch box 24.

Likewise, the switch members 48 of the switch box 24 are shiftable between a first position wherein the electrically conducting washer element 54 of the switch member 48 is spaced apart from the wires 46 carried by respective switch box sidewalls 34, 36, to a second position wherein the washer element 54 is in abutting, electrical conducting relationship with a pair of sidewall wires 46. Referring specifically to FIG. 9, it will be seen that the switch members 48 and wires 46 are arranged in parallel electrical relationship, and the alarm 22 will be actuated upon the closing of a single switch member 48.

Referring again to FIG. 2, it will be seen that when the breaker arms 20 are in their circuit closed position, they will abut the cylindrical portion 52 of respective switch members 48, thereby maintaining the switch members 48 in the open position thereof. When the circuit associated with an individual breaker arm 20 reaches an overload condition, breaker arm 20 will shift to the circuit open position (see FIG. 3), and the spring 60 will shift the associated switch member 48 to its closed position. Electrical contact will then be made between the two wires 46 carried by the associated sidewall via the conducting washer element 54 of the switch member 48, connecting the audible signal device 22 to the source of operating power. It will thus be seen that the audible signal device 22 will be energized upon the shifting of any breaker arm 20 from the circuit closed to the circuit open position thereof.

Figure 1:
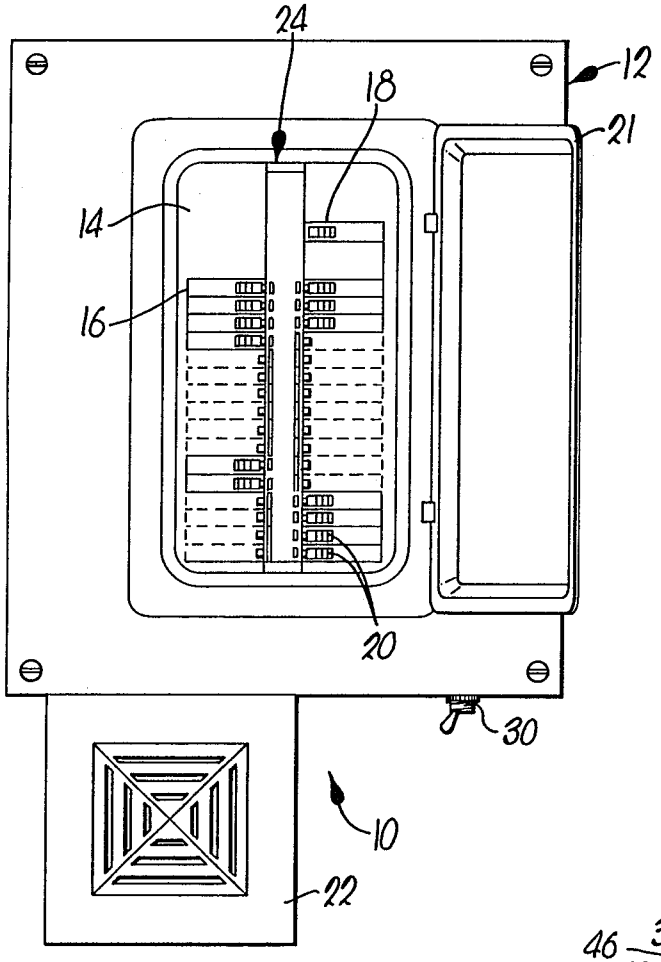
FIG. 1 a front elevational view of a conventional circuit breaker box having a circuit breaker warning device in accordance with the present invention mounted thereon.

Referring to FIG. 1, it will be noted that the circuit breaker box 12 does not include a breaker arm 20 for each and every switch member 48 of alarm device switch box 24. The switch members 48 that do not have an associated breaker arm 20 may be maintained in the opened position by placing an insert 62 through the top wall slot 42 associated with the individual switch members 48. Referring to FIG. 4, it will be seen that the insert 62 maintains the conducting washer element 54 of the associated switch member 48 in spaced apart, non-contacting relationship with sidewall wires 46.

Figure 7:
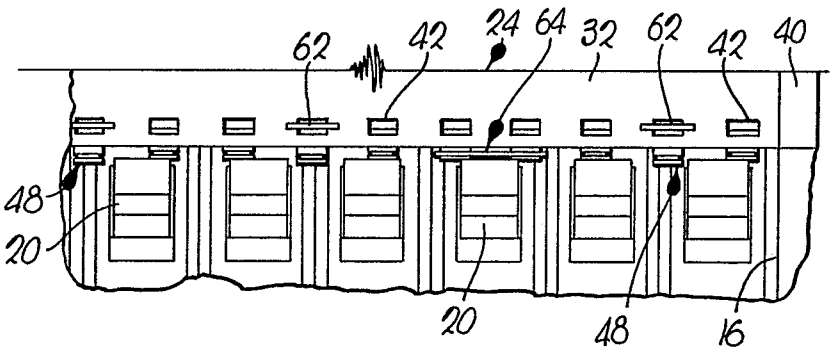
FIG. 7 is a fragmentary, front view of a circuit breaker box having an alarm device switch box mounted thereon.

The breaker arms 20 in a conventional circuit breaker box 12 are normally spaced apart a distance of either 15/32 of an inch or $\frac{3}{4}$of an inch. For this reason, the side-by-side pairs of switch members 48 are advantageously spaced apart 15/32 of an inch. As depicted in FIG. 1, when the breaker arms 20 are spaced apart at 15/32 inch intervals, the switch members 48 are aligned in one-on-one relationship with the breaker arms 20. FIGS. 7 and 8, however, depict the alignment of the switch members 48 with breaker arms 20 when the switch members 48 are spaced apart at 15/32 inch intervals, and the breaker arms are spaced apart at $\frac{3}{4}$ inch intervals. The switch box 24 may be adapted to the spacing of the breaker arms 20 in this instance by locking switch members 48 that are not associated with a breaker arm 20 into their open position by the use of an insert 62, and by connecting adjacent switch members 48 with a connecting hook 64 when the adjacent switch members 48 each only partially abut against the associated breaker arm 20.

I claim:

1. In combination:

a circuit breaker box having a face plate with at least two laterally spaced apart, juxtaposed vertical rows of circuit breaker arm-receiving openings therethrough, there being individual circuit breakers behind said vertical rows of arm-receiving openings with shiftable breaker arms extending through respective ones of said arm-receiving openings, each of said arms normally being in a circuit closed position and shiftable from said circuit closed position to a circuit open position when the corresponding circuit breaker experiences sufficient electrical overload;

an alarm device for signalling when one or more of said circuit breakers has experienced an electrical overload sufficient to shift the associated breaker arm from the circuit closed to the circuit open position thereof, said device including:

shiftable means for each of said breaker arms respectively;

means mounting said respective shiftable means between said rows of arm-receiving openings and adjacent a corresponding breaker arm for movement of the shiftable means between a first and a second position in response to overload-induced movement of said corresponding breaker arm; and means for giving a perceptible warning signal when one of said shiftable means has moved to said second position thereof.

2. The combination as claimed in claim 1, said shiftable means comprising a plurality of alarm switches in parallel electrical relationship, said switches being open when in said first position, and closed when in said second position.

3. Tne combination as claimed in claim 1, including means for biasing the individual shiftable means to said second position, said breaker arms abutting said respective shiftable means for maintaining said respective shiftable means in said first position when said breaker arms are in said circuit closed position.

4. The combination as claimed in claim 3, said shiftable means comprising side-by-side pairs of opposed switch members, said biasing means comprising means interposed between the opposed members of respective switch member pairs for urging said members of said respective pairs apart.

5. The combination as claimed in claim 1, including means for locking said selected individual shiftable means in said first position.

6. The combination as claimed in claim 1, including means for coupling selected ones of said shiftable means together for mutual shifting between said first and second positions thereof.

7. The combination as claimed in claim 1, said warning means comprising an audible alarm.

8. A circuit breaker warning device, comprising:

perceptible alarm means; and means adapted for selective coupling of said alarm means to a source of operating power, including:

a plurality of shiftable switch members, each member including an electrically conducting element;

means for mounting said members in side-by-side pairs of opposed members, said mounting means including a pair of spaced apart, opposed sidewalls having structure defining a plurality of member receiving apertures therein;

a pair of electrical contacts carried by each of said sidewalls;

biasing means interposed between each pair of opposed switch members for urging the conducting element of said members into abutting, electrically conducting relationship with respective pairs of said sidewall electrical contacts, each of said members including a portion extending through one of said sidewall apertures, said portions engageable for shifting of the respective conductor elements of said members against the urging force of said biasing means and into spaced apart, non-conducting relationship with said sidewall electrical contacts, said alarm means being connected to said source of operating power when at least one of said conducting elements are in abutting, conducting relationship with one of said pairs of sidewall electrical contacts.

9. In combination:

a circuit breaker box having a face plate having a plurality of circuit breaker arm-receiving openings therethrough, there being individual circuit breakers behind at least certain of said openings with shiftable breaker arms extending through corresponding arm-receiving openings, each of said arms normally being in a circuit closed position and shiftable from said circuit closed position to a circuit open position when the associated circuit breaker experiences sufficient circuit overload; and an alarm device for signalling when one or more of said circuit breakers has experienced electrical overload sufficient to shift the associated breaker arm from the circuit closed to the circuit open position thereof, said device including:

shiftable means for each of said breaker arms respectively;

means mounting said respective shiftable means adjacent the exterior surface of said face plate and outside the circuit breaker box remote from said individual circuit breakers and adjacent a corresponding breaker arm for movement of the shiftable means between a first and a second position in response to overload-induced movement of said corresponding breaker arm; and means for giving a perceptible warning signal when one of said shiftable means has moved to said second position thereof.

* * * * *